US009004885B2

(12) United States Patent
Ki et al.

(10) Patent No.: US 9,004,885 B2
(45) Date of Patent: Apr. 14, 2015

(54) RECIPROCATING COMPRESSOR

(75) Inventors: Sunghyun Ki, Seoul (KR); Hyuk Lee, Seoul (KR); Eonpyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 13/808,977

(22) PCT Filed: Jul. 7, 2011

(86) PCT No.: PCT/KR2011/004984

§ 371 (c)(1),
(2), (4) Date: Jan. 8, 2013

(87) PCT Pub. No.: WO2012/005530

PCT Pub. Date: Jan. 12, 2012

(65) Prior Publication Data

US 2013/0115116 A1 May 9, 2013

(30) Foreign Application Priority Data

Jul. 9, 2010 (KR) ..... 10-2010-0066543

(51) Int. Cl.
*F04B 17/04* (2006.01)
*F04B 53/16* (2006.01)
(Continued)

(52) U.S. Cl.
CPC ..... *F04B 9/00* (2013.01); *F04B 35/045* (2013.01); *F04B 39/121* (2013.01); *F04B 39/127* (2013.01)

(58) Field of Classification Search
CPC ..... F04B 35/045; F04B 39/127; F04B 17/04; F04B 19/022
USPC ..... 417/417, 363, 902
See application file for complete search history.

(56) References Cited

U.S. PATENT DOCUMENTS 3,044,401 A * 7/1962 Sawyer ..... 417/317
4,121,125 A * 10/1978 Dolz ..... 310/27
(Continued)

FOREIGN PATENT DOCUMENTS

CN 2866893 Y 2/2007
CN 101240793 A 8/2008
(Continued)

OTHER PUBLICATIONS

International Search Report issued in PCT Application No. PCT/KR2011/004984 dated Feb. 27, 2012.
(Continued)

*Primary Examiner* — Bryan Lettman
(74) *Attorney, Agent, or Firm* — Ked & Associates, LLP

(57) ABSTRACT

The present invention relates to a reciprocating compressor in which a cylinder of a compression unit is tightly fixed to a hermetic shell, and a stator of a reciprocating motor is fixed to the hermetic shell by a support spring consisting of a leaf spring, so as to reduce the gap between a compressor body and the hermetic shell and thus reduce the size of the compressor. In addition, the masses of the members of the reciprocating motor and of the compression unit, as well as the elasticity of the spring supporting the members, are properly adjusted to offset the force being applied to the hermetic shell, thereby minimizing the vibrations of the hermetic shell. Further, the relative velocity of the reciprocating motor increases such that the relative velocity of the reciprocating motor is faster than the relative velocity of the compression unit, thereby improving the efficiency of the motor.

12 Claims, 3 Drawing Sheets

(51) Int. Cl.

| | |
|---|---|
| ***F04B 9/00*** | (2006.01) |
| ***F04B 35/04*** | (2006.01) |
| ***F04B 39/12*** | (2006.01) |

(56) References Cited

U.S. PATENT DOCUMENTS

| | | | | |
|---|---|---|---|---|
| 4,374,330 | A * | 2/1983 | Fey | 307/132 E |
| 4,416,594 | A * | 11/1983 | Ichikawa | 417/360 |
| 5,704,771 | A * | 1/1998 | Fujisawa et al. | 417/417 |
| 6,742,998 | B2 * | 6/2004 | Kawahara et al. | 417/416 |
| 6,809,434 | B1 * | 10/2004 | Duncan et al. | 310/12.19 |
| 6,994,530 | B2 * | 2/2006 | Fujisawa et al. | 417/417 |
| 2005/0175482 | A1 * | 8/2005 | Park et al. | 417/416 |
| 2006/0153712 | A1 * | 7/2006 | Park | 417/417 |
| 2007/0134108 | A1 * | 6/2007 | Her | 417/417 |

FOREIGN PATENT DOCUMENTS

| | | | |
|---|---|---|---|
| CN | 201321960 | Y | 10/2009 |
| JP | 2004-011582 | | 1/2004 |
| KR | 10-1999-0065327 | | 8/1999 |
| KR | 10-2006-0081481 | | 7/2006 |
| KR | 10-2007-0103252 | | 10/2007 |

OTHER PUBLICATIONS

Chinese Office Action dated Sep. 25, 2014, issued in Application No. 201180034013.5.

* cited by examiner

RECIPROCATING COMPRESSOR

CROSS REFERENCE TO RELATED PATENT APPLICATIONS

This application is a U.S National Stage Application under 35 U.S.C. §371 of PCT Application No. PCT/KR2011/004984, filed Jul. 7, 2011, in Korea, which claims priority to Korean Patent Application No. 10-2010-0066543, filed Jul. 9, 2010, in Korea, whose entire disclosures are hereby incorporated by reference.

TECHNICAL FIELD

The present invention relates to a reciprocating compressor and, more particularly, to a reciprocating compressor using vibration.

BACKGROUND ART

In general, a reciprocating compressor is a compressor in which a piston linearly reciprocates within a cylinder to suck, compress, and discharge a refrigerant. The reciprocating compressor may be classified into a connection type reciprocating compressor and a vibration type reciprocating compressor according to a piston driving method.

In the connection type reciprocating compressor, a piston is connected to a rotational shaft of a rotary motor by a connecting rod and reciprocates within a cylinder to compress a refrigerant. Meanwhile, in the vibration type reciprocating compressor, a piston is connected to a mover of a reciprocating motor which reciprocates, so as to vibrate together and reciprocate to compress a refrigerant. The present invention relates to a vibration type reciprocating compressor, and hereinafter, the vibration type reciprocating compressor will be referred to as a reciprocating compressor.

In the reciprocating compressor, the piston and the cylinder relatively reciprocate in a magnetic flux direction of the reciprocating motor to repeatedly perform a sequential process of sucking, compressing, and discharging a refrigerant.

DISCLOSURE

Technical Problem

However, in the related art reciprocating compressor, a compressor main body comprised of a reciprocating motor and a compression unit is installed to vibrate in a horizontal direction in an internal of an airtight container and supported by a support spring as a coil spring. Namely, a predetermined space is required for the compressor main body to be supported by the support spring between the airtight container and the compressor main body, increasing a size of the compressor.

In addition, in the related art reciprocating compressor, since the support spring is connected to a stator of a reciprocating motor and a cylinder of a compression unit and fixed in the airtight container, vibration of the reciprocating motor and that of the compression unit are transmitted to the airtight container as is to increase compressor vibration.

Also, in the related art reciprocating compressor, a stator of the reciprocating motor is integrally coupled to the cylinder of the compression unit or connected by a resonance spring, and a mover of the reciprocating motor is integrally connected to the piston of the compression unit, and thus, a velocity of the reciprocating motor and a relative velocity of the compression unit are equal. As a result, there is a limitation in increasing a relative velocity of the reciprocating motor, degrading compressor efficiency.

Therefore, an object of the present invention is to provide a reciprocating compressor reduced in size by reducing a space between a compressor main body and an airtight container.

Another object of the present invention is to provide a reciprocating compressor in which compressor vibration is attenuated by offsetting vibration of a reciprocating motor and vibration of a compression unit.

Another object of the present invention is to provide a reciprocating compressor in which a velocity of a reciprocating motor is increased by differently controlling a relative velocity of a reciprocating motor and a relative velocity of a compression unit, thus enhancing compressor efficiency.

Technical Solution

According to an aspect of the present invention, there is provided a reciprocating compressor including: an airtight container; a reciprocating motor including stators fixed within the airtight container and a mover reciprocating in an air gap between the stators; a piston coupled to the mover to make a reciprocal motion; and a cylinder coupled within the airtight container such that it is spaced apart from the reciprocating motor and allowing the piston to be inserted therein to form a compression space, wherein any one of the stator of the reciprocating motor and the cylinder is fixedly coupled to an inner circumferential surface of the airtight container and the other is coupled to the airtight container and supported by a spring.

Advantageous Effects

In the case of the reciprocating compressor according to embodiments of the present invention, since the cylinder of the compression unit is tightly attached and fixed to the airtight container and the stator of the reciprocating motor is fixed to the airtight container by the support spring, a space between the compressor main body and the airtight container is reduced to reduce a size of the compressor. In addition, since the cylinder of the compression unit is tightly attached to the airtight container, a pipe such as a loop pipe is not required, reducing fabrication cost.

Also, force applied to the airtight container may be offset by appropriately adjusting a mass of the stator of the reciprocating motor and stiffness of the supporting spring, and a mass of the mover of the reciprocating motor, a mass of the piston of the compression unit, and stiffness of the resonance spring, whereby vibration of the airtight container can be minimized.

Also, a relative velocity of the reciprocating motor can be adjusted to be faster than that of the compression unit, thereby increasing motor efficiency.

BEST MODES

Hereinafter, a reciprocating compressor will be described in detail with reference to a reciprocating compressor illustrated in the accompanying drawings.

Figure 1:
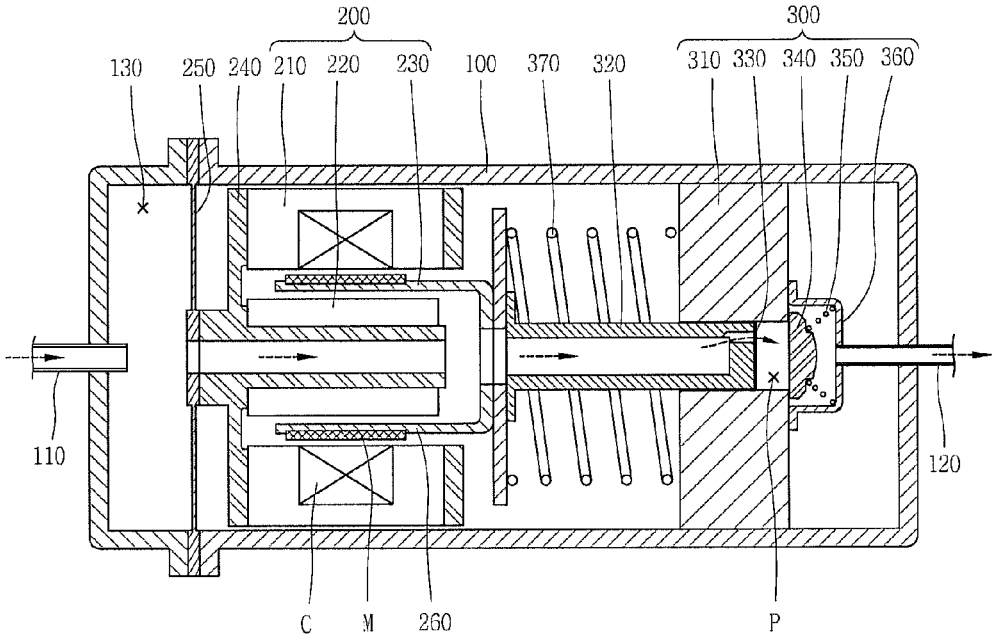
FIG. 1 is a vertical sectional view illustrating an example of a reciprocating compressor according to an embodiment of the present invention.
Figure 2:
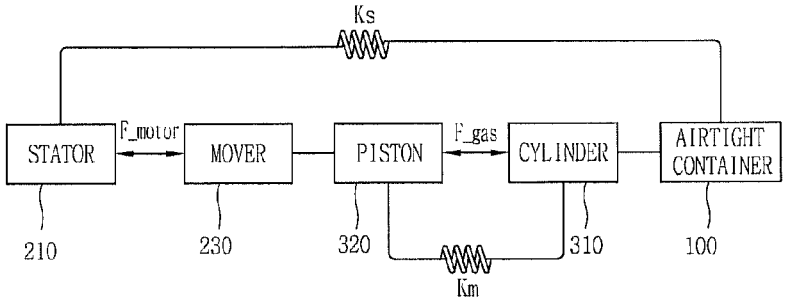
FIG. 2 is a view illustrating a structure of the reciprocating compressor of FIG. 1.

FIG. 1 is a vertical sectional view illustrating an example of a reciprocating compressor according to an embodiment of the present invention, and FIG. 2 is a view illustrating a structure of the reciprocating compressor of FIG. 1.

Referring to FIG. 1, in the reciprocating compressor according to an embodiment of the present invention, a gas suction pipe 110 and a gate discharge pipe 120 are formed to be connected to both ends of an airtight container 100, a reciprocating motor 200 which linearly reciprocates is installed within the airtight container 100, and a compression unit 300 in which a piston 320 connected to a mover 230 of the reciprocating motor 200 reciprocates to compress a refrigerant is installed to be spaced apart from the reciprocating motor 200 within the airtight container 100.

The gas suction pipe 110 and the gate discharge pipe 120 are connected to both sides of the airtight container 100 in a penetrative manner. An end of the gas suction pipe 110 is connected to communicate with an internal space 130 of the airtight container 100, and an end of the gas discharge pipe 120 is directly connected to a discharge cover 360 (to be described).

The reciprocating motor 200 includes an outer stator 210 having a coil C and coupled to the airtight container 100 such that it can vibrate, an inner stator 220 installed at an inner side of the outer stator 210 with an air gap having a certain space present therebetween and coupled to the airtight container 100 such that it can vibrate together with the outer stator 210, and a mover 230 linearly reciprocating between the outer stator 210 and the inner stator 220.

The outer stator 210 and the inner stator 220 may be formed by laminating a plurality of sheets of thin stator cores in a cylindrical shape or laminating a plurality of sheets of thin stator cores in a block shape and radially arranging them.

The outer stator 210 and the inner stator 220 are supported in a frame 240 coupled to the airtight container 100 such that the frame 240 may vibrate, and coupled to a support spring 250 (to be described).

The support spring 250 for coupling the stator 210 of the reciprocating motor 200 to the airtight container 100 is coupled to the other side of the frame 240. The support spring 250 is configured as a leaf spring (or a leaf spring) having an outer circumferential fixed to the airtight container 100 and a central portion to which the frame 240 is coupled.

The mover 230 includes a cylindrical magnet holder 260, and a plurality of magnets M are fixedly coupled to an outer circumferential surface of the magnet holder 260. The piston 320 is integrally coupled to one end of the magnet holder 260 by a bolt.

The compression unit 300 includes a cylinder 310 fixedly coupled to an inner circumferential surface of the airtight container 100, a piston 320 coupled to the mover 230 of the reciprocating motor 200 and reciprocating in a compression space P of the cylinder 310, a suction valve 330 installed in a front end of the piston 320 to open and close a suction side of the compression space P, a discharge valve 340 detachably installed in the cylinder 310 to open and close a discharge side of the compression space P, a valve spring 350 elastically supporting the discharge valve 340, and a discharge cover 360 fixed to the discharge side of the cylinder 310 such that it accommodates the discharge valve 340 and the valve spring 350.

The cylinder 310 is fixed such that an outer circumferential surface thereof is tightly attached to an inner surface of the airtight container 100. An annular compression space P is formed in a central portion of the cylinder 310.

The piston 320 is formed to have a cylindrical shape to form a suction flow channel 321 therein. A plurality of suction through holes (no reference numeral is given) may be formed on an outlet of the suction flow channel 321 such that they communicate with the suction flow channel 321.

The suction valve 330 is installed in a front end surface of the piston 320 to open and close the suction flow channel 321. A resonance spring 370 inducing a resonant motion of the piston 320 is installed between one side of a connection portion of the piston 320 coupled to the magnet holder 260 and the cylinder 310. The resonance spring 370 may be configured as a compression coil spring having a predetermined modulus of elasticity.

The reciprocating compressor according to an embodiment of the present invention as described above operates as follows.

Namely, when power is applied to the coil C of the reciprocating motor 200, magnetic flux is formed between the outer stator 210 and the inner stator 220. Then, the mover 230 placed in the air gap between the outer stator 210 and the inner stator 220 moves in the direction of the magnetic flux and continuously reciprocates by the resonance spring 370.

Then, the piston 320 coupled to the mover 230 reciprocates in the compression space P of the cylinder 310 to suck and compress a refrigerant and discharge the compressed refrigerant through the discharge valve 340, and the discharged refrigerant is discharged to a refrigerating cycle system through the gas discharge pipe 120. This sequential process is repeatedly performed.

Here, when the reciprocating motor 200 is driven, force is transmitted to the stators 210 and 220 of the reciprocating motor 200 and the mover 230, and in this case, force transmitted to the stators 210 and 220 is transmitted to the airtight container 100 through the support spring 250, and force transmitted to the mover 230 is transmitted to the piston 320 of the compression unit 300. Here, force transmitted to the piston 320 is used to compress the refrigerant and is transmitted to the airtight container 100 through the resonance spring 370 and the cylinder 310 of the compression unit 300. Thus, force applied to the airtight container 100 may be offset by appropriately adjusting a mass of the stators 210 and 220 of the reciprocating motor 200 and stiffness of the support spring 250, and a mass of the mover 230 of the reciprocating motor 200, a mass of the piston 320 of the compression unit 300, and stiffness of the resonance spring 370, whereby vibration of the airtight container 100 can be minimized.

For example, a vibration model of the reciprocating motor may be configured with reference to FIG. 2 as shown below.

$$\begin{bmatrix} M_m s^2 + K_s & 0 & -K_s \\ 0 & M_p s^2 + K_m & -K_m \\ -K_s & -K_m & M_s s^2 + K_s + K_m \end{bmatrix} \begin{Bmatrix} X_m(s) \\ X_p(s) \\ X_s(s) \end{Bmatrix} = \begin{Bmatrix} -F_{motor}(s) \\ F_{gas}(s) + F_{motor}(s) \\ -F_{gas}(s) \end{Bmatrix}$$

Here, when Mm×Ks=Mp×Km, vibration Xs of the airtight container 100 becomes zero. Thus, vibration of the compressor may be considerably reduced by discovering a point at which vibration of the airtight container 100 becomes zero and appropriately adjusting the foregoing variables.

Also, since the stators 210 and 220 of the reciprocating motor 200 has a displacement, a relative displacement of the mover 230 and the stators 210 and 220 of the reciprocating motor 200 and a relative displacement of the piston 320 and the cylinder 310 of the compression unit 300 differ. By using such characteristics, a relative velocity (Xm−Xp) of the reciprocating motor 200 may be adjusted to be higher than a relative velocity (Xs−Xp) of the compression unit 300, and such characteristics increase motor efficiency.

Also, by tightly attaching and fixing the cylinder 310 of the compression unit 300 to the airtight container 100 and fixing the stators 210 and 220 of the reciprocating motor 200 to the airtight container 100 with the spring 250 configured as a leaf spring, a space between the compressor main body and the airtight container may be reduced to reduce the size of the compressor. In addition, since the cylinder 310 of the compression unit 300 is tightly attached to the airtight container 100, there is no need to install a pipe such as a loop pipe having elasticity for sending a compressed refrigerant to the cycle, and thus, fabrication cost can be reduced.

MODE FOR INVENTION

Meanwhile, a reciprocating motor according to another embodiment of the present invention will be described.

Figure 3:
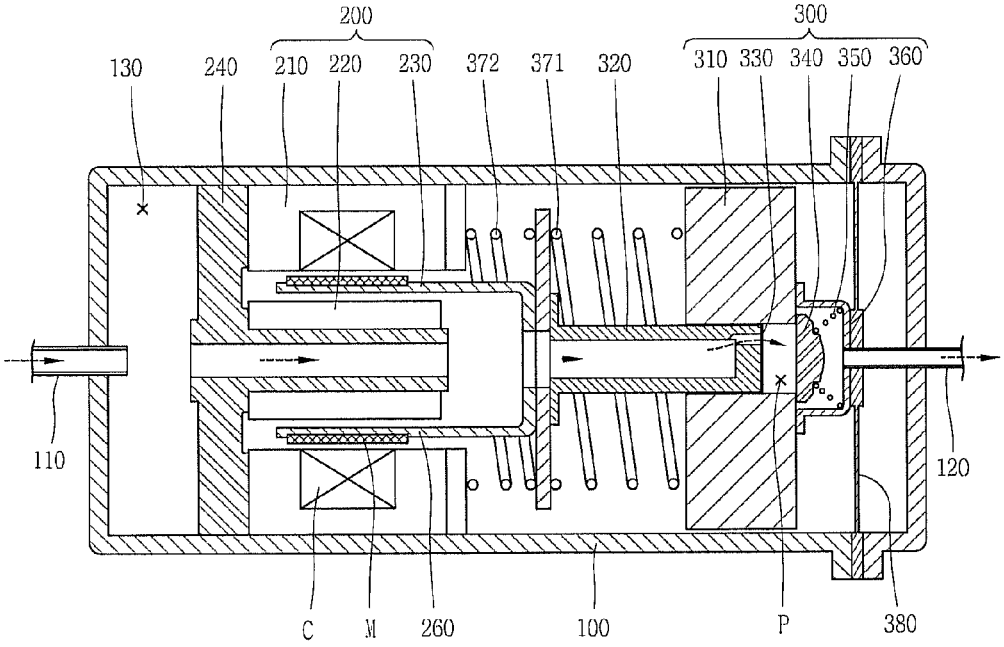
FIG. 3 is a vertical sectional view illustrating another example of a reciprocating compressor according to an embodiment of the present invention.

Namely, in the foregoing embodiment, the stators of the reciprocating motor are supported by the leaf spring and fixed to the airtight container, while the cylinder is directly fixed to the airtight container. In comparison, in the present embodiment, as illustrated in FIG. 3, the frame 240 supporting the stators 210 and 220 is directly fixed to the airtight container 100, while the cylinder 310 is supported by a support spring 380 configured as a leaf spring and the supporting spring 380 is fixed to the airtight container 100.

In this case, a basic configuration and operational effect of the reciprocating compressor according to the present embodiment are similar to those of the foregoing embodiment, so a detailed description thereof will be omitted. However, in the present invention, preferably, a first resonance spring 371 is installed between the piston 320 and the cylinder 310 of the compression unit 300 and a second resonance spring 372 is installed between the outer stator 210 and the mover 230 of the reciprocating motor 200 to induce a resonant motion of the mover 230 and the piston 320.

Figure 4:
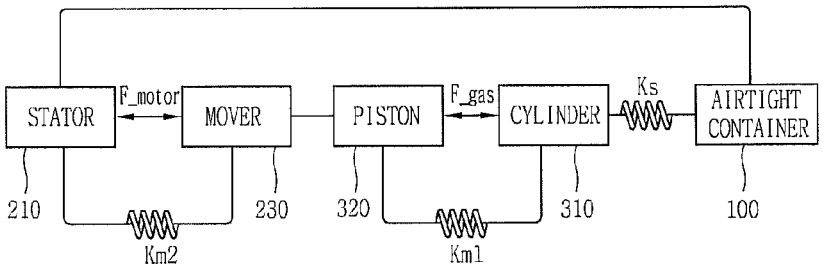
FIG. 4 is a view illustrating a structure of the reciprocating compressor of FIG. 3.

In this case, a vibration mode with reference to FIG. 4 is as follows.

$$\begin{bmatrix} M_{cy}s^2 + K_s + K_{m1} & -K_{m1} & -K_s \\ -K_{m1} & M_p s^2 + K_{m1} + K_{m2} & -K_{m2} \\ -K_s & -K_{m2} & M_s s^2 + K_s + K_{m2} \end{bmatrix} \begin{Bmatrix} X_{cy}(s) \\ X_p(s) \\ X_s(s) \end{Bmatrix} = \begin{Bmatrix} -F_{gas}(s) \\ F_{gas}(s) + F_{motor}(s) \\ -F_{motor}(s) \end{Bmatrix}$$

Namely, in the foregoing vibration mode, M and K for minimizing vibration Xs may be selected, based on which a region in which a relative velocity of the reciprocating motor 200 and a relative velocity of the compression unit 300 are different and a relative velocity of the reciprocating motor 200 is high may be selected to increase motor efficiency.

Meanwhile, a reciprocating compressor according still another embodiment of the present invention will be described.

Figure 5:
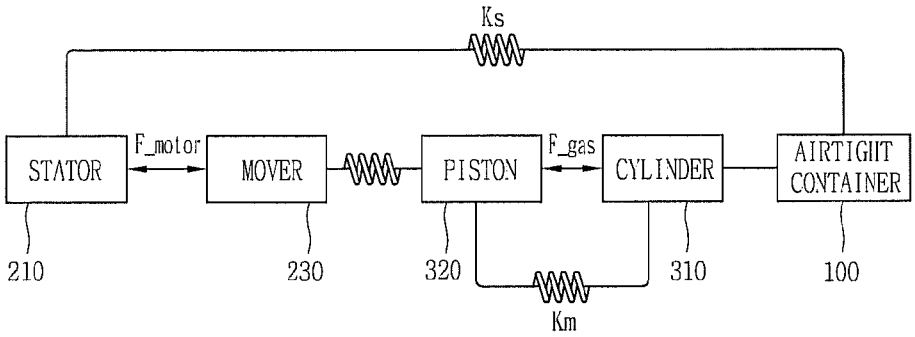
FIGS. 5 and 6 are views illustrating a structure of another example of the reciprocating compressor according to an embodiment of the present invention.
Figure 6:
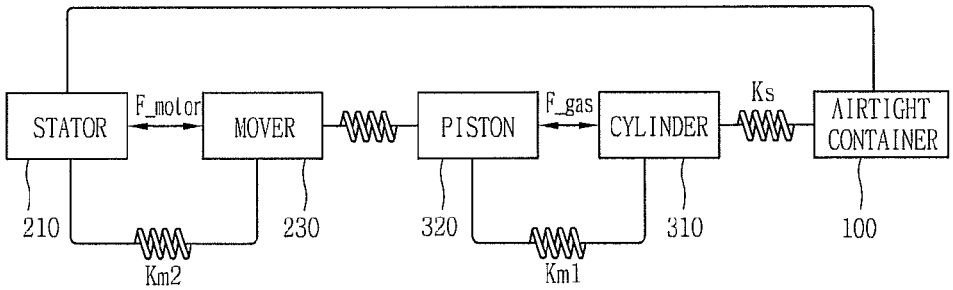

Namely, in the foregoing embodiments, the mover of the reciprocating motor and the piston of the compression unit are integrally coupled. In comparison, in the present embodiment, as illustrated in FIGS. 5 and 6, the mover 230 and the piston 320 as those in the foregoing embodiments are coupled by a spring (not shown).

In this case, a basic configuration and operational effect of the reciprocating compressor according to the present embodiment are similar to those of the foregoing embodiment, so a detailed description thereof will be omitted. However, in the present invention, since the mover 230 of the reciprocating motor 200 and the piston 320 of the compression unit 300 are coupled by a spring such as a compression coil spring, a relative velocity of the reciprocating motor 200 and a relative velocity of the compression unit 300 may be more reliably implemented, further increasing motor efficiency.

The invention claimed is:

1. A reciprocating compressor comprising:

an airtight container;

a reciprocating motor including stators fixed within the airtight container and a mover reciprocating in an air gap between the stators;

a piston coupled to the mover to make a reciprocal motion; and a cylinder coupled within the airtight container such that it is spaced apart from the reciprocating motor and allowing the piston to be inserted therein to form a compression space, wherein any one of the stators of the reciprocating motor and the cylinder is fixedly coupled to an inner circumferential surface of the airtight container and the other is coupled to the airtight container and supported by a spring.

2. The reciprocating compressor of claim 1, wherein the cylinder is fixed such that an outer circumferential surface thereof is tightly attached to the inner circumferential surface of the airtight container, and the stators of the reciprocating motor are coupled to a spring fixed to the airtight container.

3. The reciprocating compressor of claim 2, wherein the spring coupling the stators and the airtight container is configured as a leaf spring to elastically support the stators in a movement direction and a radial direction of the piston.

4. The reciprocating compressor of claim 2, wherein a spring configured to induce a reciprocal movement of the piston is interposed between the piston and the cylinder.

5. The reciprocating compressor of claim 2, wherein a discharge cover accommodating a discharge valve is coupled to a discharge side of the cylinder, and a discharge pipe penetrating the airtight container is directly connected to the discharge cover.

6. The reciprocating compressor of claim 1, wherein outer circumferential surfaces of the stators of the reciprocating motor are tightly attached and fixed to the inner circumferential surface of the airtight container, and the cylinder is coupled to a spring fixed to the airtight container.

7. The reciprocating compressor of claim 6, wherein the spring coupling the cylinder and the airtight container is configured as a leaf spring elastically supporting the cylinder in a movement direction and a radial direction of the piston.

8. The reciprocating compressor of claim 6, wherein a spring configured to induce a reciprocal movement of the mover is interposed between the stators and the mover of the reciprocating motor.

9. The reciprocating compressor of claim 6, wherein a spring configured to induce a reciprocal movement of the piston is interposed between the piston and the cylinder.

10. The reciprocating compressor of claim 6, wherein a suction pipe communicates with an internal space of the airtight container, the piston includes a suction flow channel formed in a penetrative manner to allow the internal space of the airtight container and a compression space of the cylinder to communicate with each other, a suction valve configured to open and close the suction flow channel is installed at the end of the piston, and a discharge valve configured to open and close the compression space of the cylinder is installed at an outlet of the compression space.

11. The reciprocating compressor of claim 1, wherein the mover and the piston are mechanically coupled.

12. The reciprocating compressor of claim 1, wherein the mover and the piston are elastically coupled by using a spring.

* * * * *